United States Patent [19]

Meyers

[11] 4,179,060

[45] Dec. 18, 1979

[54] DISPLAY CARTON

[75] Inventor: George L. Meyers, Menasha, Wis.

[73] Assignee: American Can Company, Greenwich, Conn.

[21] Appl. No.: 918,692

[22] Filed: Jun. 23, 1978

Related U.S. Application Data

[63] Continuation-in-part of Ser. No. 860,563, Dec. 14, 1977, abandoned.

[51] Int. Cl.[2] ..... B65D 5/00

[52] U.S. Cl. ..... 229/8; 229/41 C; 229/53; 206/277

[58] Field of Search ..... 206/277, 45.14, 491, 206/459; 229/41 B, 41 C, 41 D, 8, 9, 38, 22, 21, 53, 58

[56] References Cited

U.S. PATENT DOCUMENTS

| | | | |
|---|---|---|---|
| 1,470,172 | 10/1923 | Labombarde | 229/53 |
| 2,984,401 | 5/1961 | Merkender | 206/1.5 X |
| 3,145,898 | 8/1964 | Struble | 206/491 X |
| 3,315,931 | 4/1967 | Puckett | 206/45.14 X |
| 3,405,859 | 10/1968 | Phillips, Jr. | 229/8 |
| 3,411,692 | 11/1968 | Mathews | 229/41 C X |
| 3,765,594 | 10/1973 | Cramphorn | 229/8 X |
| 3,924,736 | 12/1975 | Bell et al. | 206/45.14 |

FOREIGN PATENT DOCUMENTS

| | | | |
|---|---|---|---|
| 1549519 | 4/1902 | France | 229/8 |

*Primary Examiner*—Joseph Man-Fu Moy
*Attorney, Agent, or Firm*—Robert P. Auber; Ira S. Dorman; George P. Ziehmer

[57] ABSTRACT

A display carton shaped generally in the shape of the article enclosed, and it may optionally have advertising thereon.

4 Claims, 22 Drawing Figures

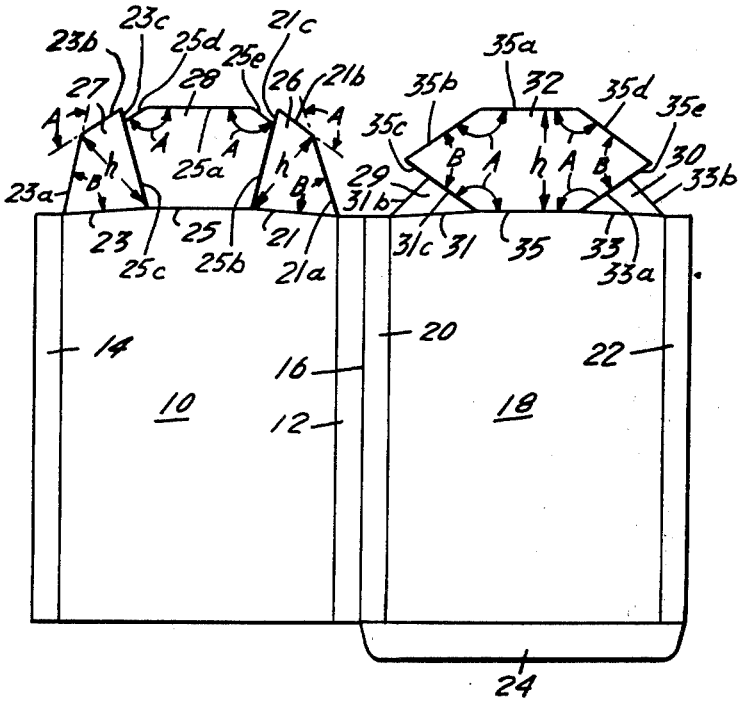

DISPLAY CARTON

BACKGROUND OF THE INVENTION

This is a continuation in part of U.S. patent application, Ser. No. 860,563 filed Dec. 14, 1977 for a "DISPLAY CARTON", now abandoned.

During manufacturing and handling, tubes of products such as a tooth paste, glue, and other such items are frequently dented or disfigured. They are sometimes displayed in transparent display cartons but a bent or disfigured tube is rejected by the buyer.

BRIEF DESCRIPTION OF THE INVENTION

The carton configurations of this invention are adapted to surround another carton, pouch, or tube, without actually showing it. Panels are also provided for advertising display.

It is therefore an object of this invention to provide a display carton.

It is another object of this invention to provide a carton blank for the fabrication of such a display carton.

It is also an object of this invention to enclose other items with a display carton while the shape of the carton suggests the shape of the enclosed item.

BRIEF DESCRIPTION OF THE DRAWINGS

Other objects will become apparent from the following description, taken in connection with the accompanying drawings, in which.

DETAILED DESCRIPTION OF THE INVENTION

Figure 1:
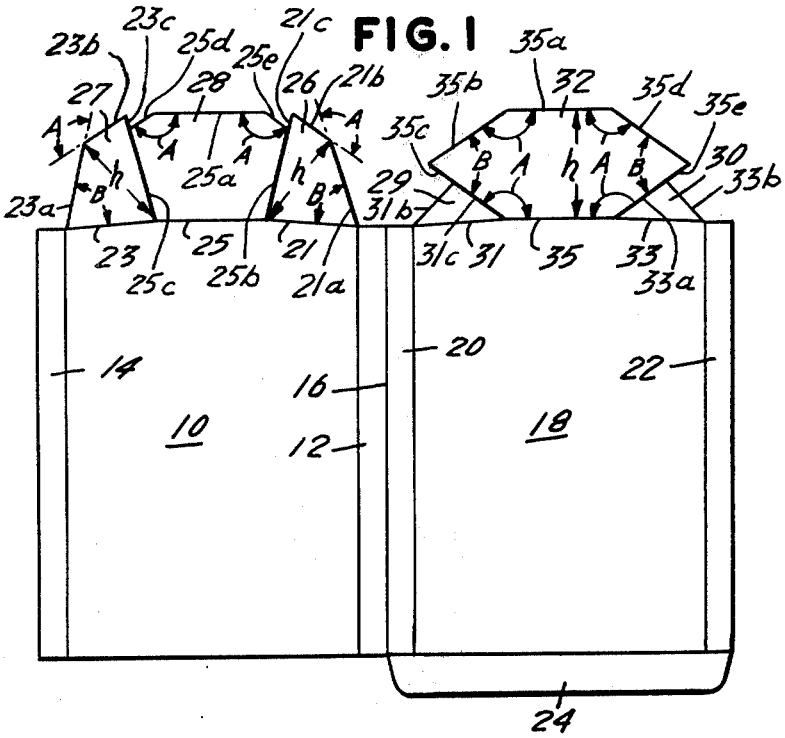
FIG. 1 is a blank of a first embodiment of this invention.

Referring to FIGS. 1 through 10, showing the first embodiment of the invention, a front panel 10 having glue margins 12 and 14 is folded at a fold line 16 over the rear panel 18. The panel 18 has side glue margins 20 and 22 and a top fold-over flap 24. Bottom tabs 26, 27, and 28 are attached at fold lines 21, 23, and 25 to the bottom end (shown at the top in FIG. 1) of panel 10. Overlapping tabs 29 and 30 and bottom panel 32 are attached at fold lines 31, 33, and 35 to the bottom (shown at the top in FIG. 1) of the front panel 18.

Figure 2:
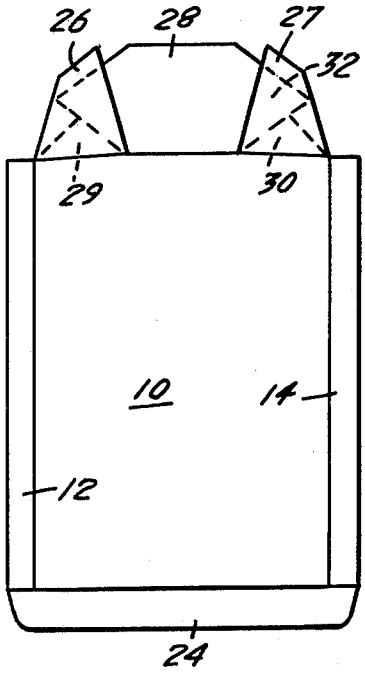
FIG. 2 shows the blank of FIG. 1 after a first fold.
Figure 3:
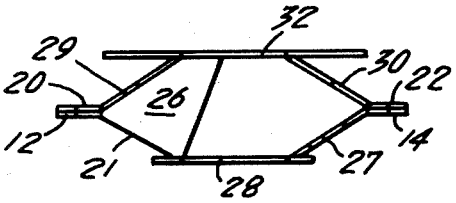
FIGS. 3 through 7 show the order of the folding of the bottom tabs and panel in the carton embodiment of FIG. 1.
Figure 6:
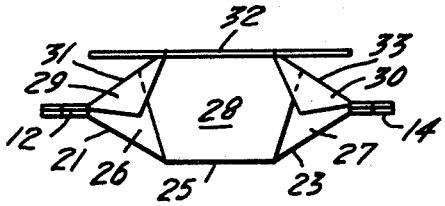

As shown in FIG. 2, the first step in assembling the carton of this invention is to fold the back and the front together at the fold line 16. The margins 12 and 14 are then glued or otherwise fastened to margins 20 and 22.

FIGS. 3 through 7 show the sequence of folding over the panels at the bottom of the carton to form a finished carton. It is seen that the sequence of folding elements is 26, 27, 28, 29, 30 and panel 32. The bottom tabs and the base are held together, for example, by glue or other sealing means. Preferably only the base 32 is glued to the tabs. The particular sequence is preferred but not critical, but note that the bottom panel 32 is shaped in the desired shape of the bottom and it is on the outside. Each tab, from the outside panel inward, supports and reinforces the edges of the tabs on top of it.

The panel 32 is centered at the bottom of panel 18, and it is the shape of the bottom of the finished carton. It is shown in the shape of an irregular hexagon with a width "h". The two longer edges are the equal edges 35 and the opposite edge 35*a*. The other four edges 35*b, c, d, e* are equal and shorter than the edge 35. The angles "A" are equal, and the angles "B" are equal. Angle "A" is supplementary to the angle "B/2".

The panels 26 and 27 are mirror images of each other, and the angles "A" and "B" are shown. If the hinge lines 21, 23 be considered the first edges of the trapezoid the second edges 21*a*, 23*a*, are turned from the first edges by internal angles "B". The third edges 21*b*, 23*b* are turned from the second edges by internal angles "A". The first edges 21, 23 and the second edges 21*a*, 23*a* of the trapezoidal flaps 26, 27 are equal to the lengths of the shorter edges 35*b, c, d, e* of outside panel 32 as shown particularly in FIGS. 3 and 4. The distances between the junction of the fourth edges 21*c*, 23*c* and the first edges 21, 23 and the junction between the second edges 21*a*, 23*a* and the third edges 21*b*, 23*b* are equal to "h". The fourth edges 21*c*, 23*c*, in the blank of FIGS. 1 and 2, are colinear with the adjacent edges 25*b*, 25*c* of panel 28.

Panel 28 is an irregular hexagon which is centered at the bottom panel 10. The length of the hinge edge 25 is equal to that of the opposite edge 25*a*. The two edges 25*b*, 25*c* adjacent panels 26, 27 are colinear with the adjacent edges 21*c*, 23*c* of panels 26, 27. The internal angles "A" are between edges 25*a*, 25*d* and edges 25*a*, 25*e*.

The triangular panels 31 and 33 are substantially identical and positioned on opposite ends of the panel 32. The edges 31*a*, 33*a* are colinear with the adjacent edges 35*c* and 35*e* of panel 32.

Figure 4:
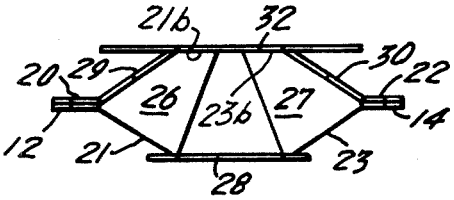
Figure 7:
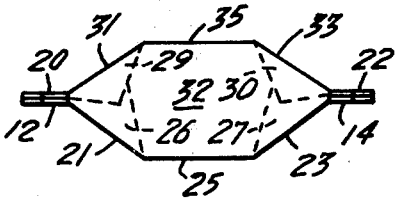
Figure 5:
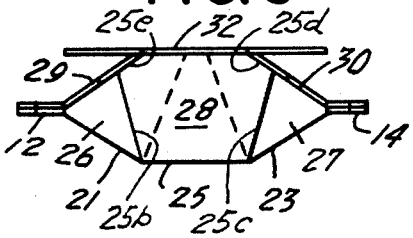

The edges 21*b*, 23*c*, when panels 26, 27 are folded as shown in FIG. 4, conform to the shape of the bottom of the carton. The panel 28 overlaps the panels 26, 27 and conforms to the shape of the bottom of the carton as shown in FIG. 5. If edges 21*b*, 23*b* were longer, edges 25*d* and 25*e* would be shorter. If edges 21*b*, 23*b* were shorter, 25*d*, 25*e* would be longer. The relative lengths are a compromise substantially to maximize the area of overlap so that panel 28 adequately supports panels 26, 27.

The positions of edges 31*b* and 33*b* are chosen so that when panels 29 and 30 are folded over panels 26, 27, 28, the amount of area of panels 26, 27 not covered by panels 29, 30 is substantially equal to the area of panels 29, 30.

Figure 8:
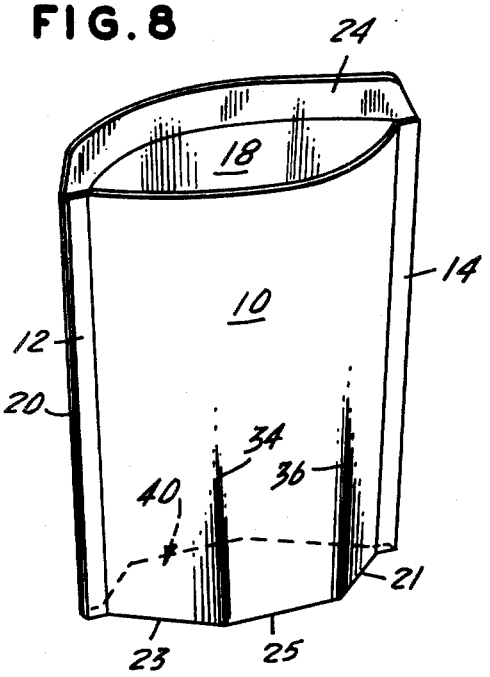
FIG. 8 shows the carton of FIG. 1 assembled and with the top open.
Figure 9:
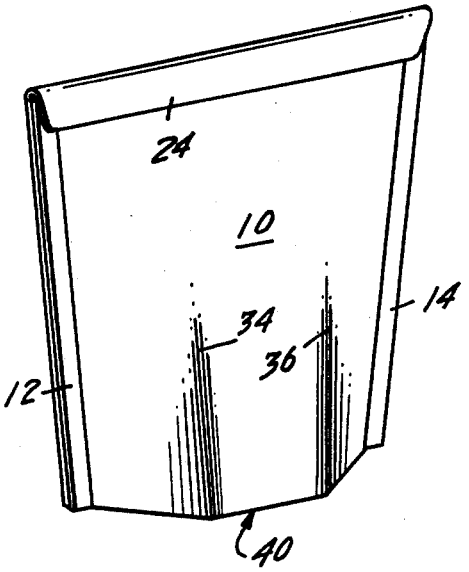
FIG. 9 show the embodiment of FIG. 1 with the top closed.

The assembled carton, with its topside up, is shown in FIG. 8, the front panel 10 is shown modified by the crease lines or scores 34 and 36. The base 40 is shown dotted. FIG. 9 shows the embodiment of FIG. 8 but with the flap 24 overlying and closing the open end of the carton and preferably fastened to the panel 10 by gluing or some other means.

Figure 10:
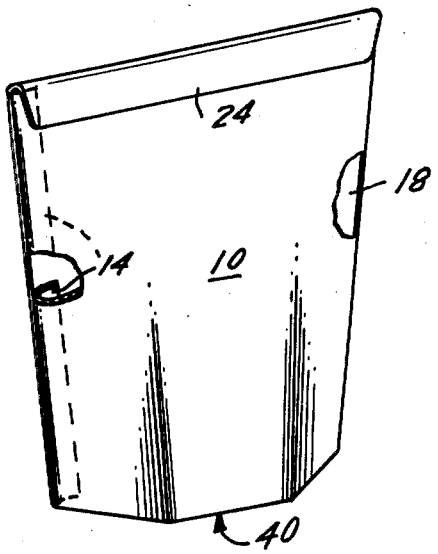
FIG. 10 shows an alternative gluing structure for the edges of the carton.
Figure 11:
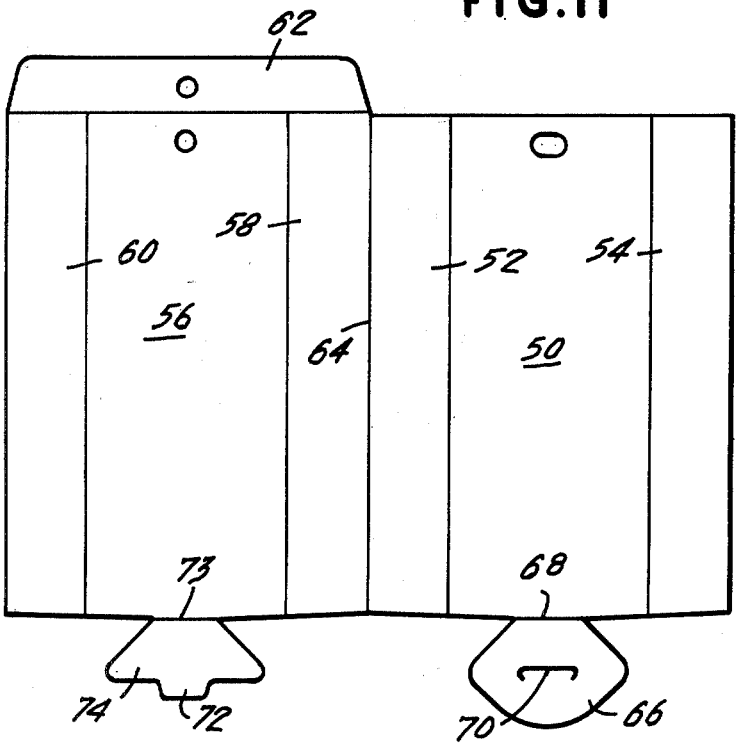
FIG. 11 shows a blank of a second embodiment of the invention.

FIG. 10 shows a slightly different construction. Instead of having the faces of margins 12 and 14 fastened to the opposing faces of margins 20 and 22 as shown in FIG. 8, the margins 12, 20 and 22 are omitted, and the margin 14 is rolled or bent over so that only the edge of panel 18 is exposed.

Figure 12:
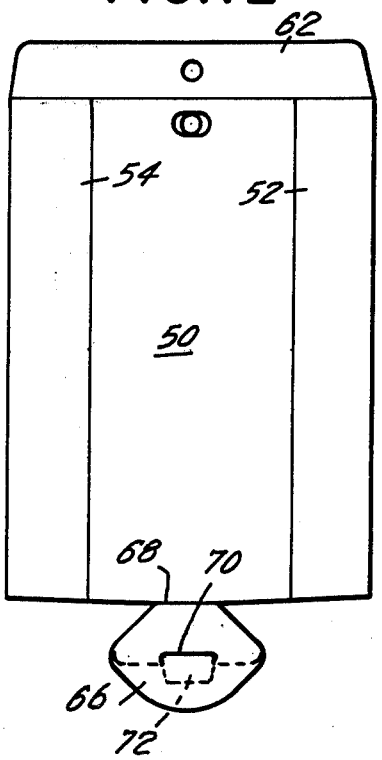
FIG. 12 shows the embodiment of FIG. 11 after the first fold.
Figure 13:
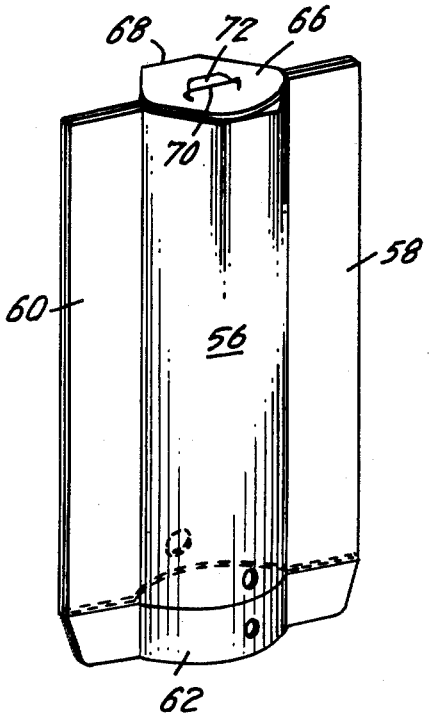
FIG. 13 shows the bottom of the embodiment of FIG. 11 assembled.
Figure 14:
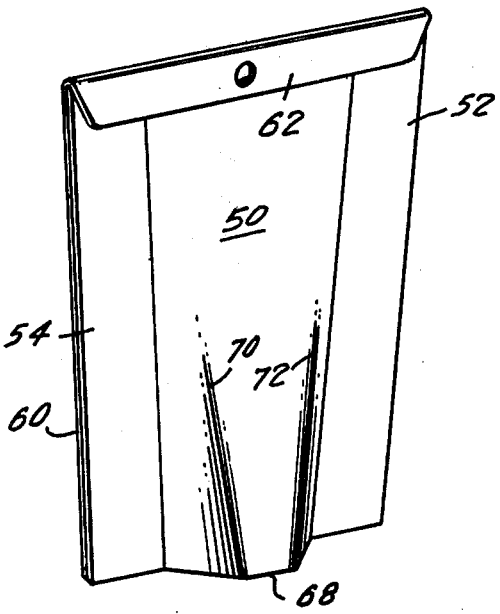
FIG. 14 shows the top of the embodiment of FIG. 11.
Figure 15:
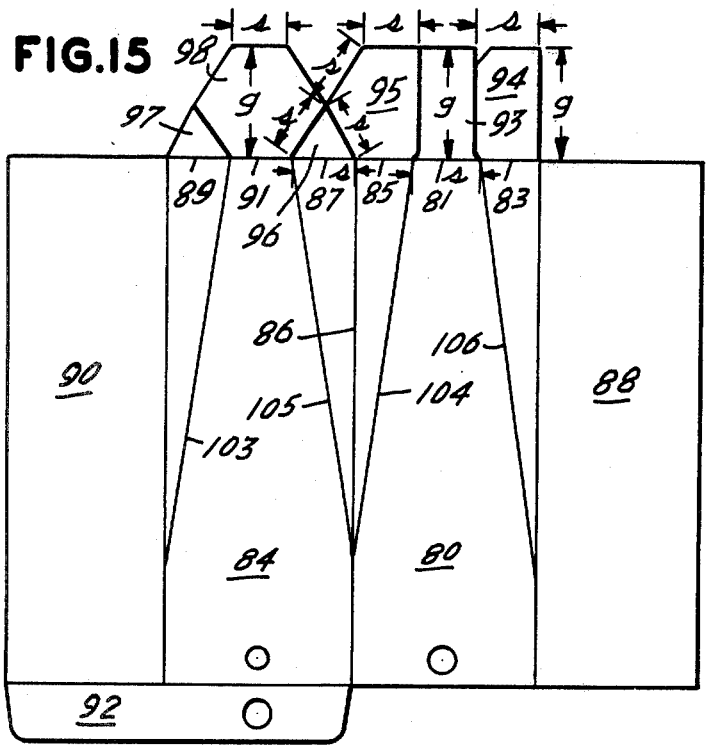
FIG. 15 shows a blank of a third embodiment of the invention.
Figure 16:
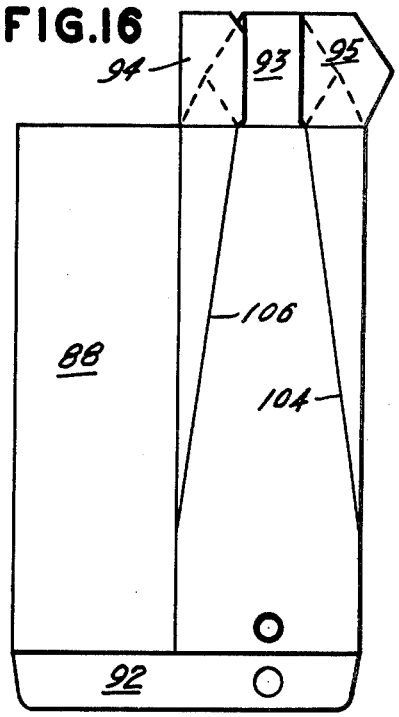
FIG. 16 shows the blank of FIG. 15 after a first fold.
Figure 17:
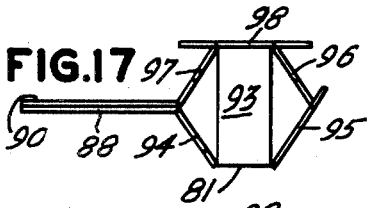
FIGS. 17 through 21 show the sequence of folding over the bottom tabs and panel to assemble the carton of FIG. 15.

In the embodiment of FIGS. 11 through 14, the front panel 50 has a pair of wide margins 52 and 54. The rear panel 56 also has a pair of wide margins 58 and 60. The top of the rear panel has a fold over flap 62, and the front and rear panels 50 and 56 are folded together at the fold line 64. The margins 52 and 54, as shown in FIGS. 13 and 14, may be used for advertising. A bottom panel 66 is attached to the bottom of panel 50 by a fold line 68. The panel 66 has a slot 70 therein for receiving the tongue 72 of the flap 74. The flap 74 is attached to the bottom of panel 56 by the fold line 73. After the panels 50 and 56 are folded together as shown in FIG. 12, the tongue 72 is placed in the groove or slot 70 to form the bottom of the display package. The assembled display package is shown in FIGS. 13 and 14. An item such as a flash light may be inserted, and the item itself keeps the pouch expanded. The panel 66 and the flap 74 may be glued together. As shown in FIG. 14, the carton may have fold lines or scores 70 and 72 to give a rounded contour to the carton.

FIGS. 15 through 22 teach a third embodiment of the carton of this invention. The blank of FIG. 15 comprises a front panel 80 and rear panel 84 separated by a fold line 86 having two exceptionally wide adjacent matching panels 88 and 90 on the extreme edges thereof. A fold over flap 92 is on the top thereof (shown at the bottom of FIG. 15), and the bottom of the carton is closed by bottom flaps 93, 94, and 95 which are folded on fold lines 81, 83, 85, from the bottom of panel 80. Flaps 96, 97 and bottom panel 98, are folded on fold lines 87, 89, 91 from the bottom of panel 84. FIGS. 17 through 21 show the sequence of folding of the bottom flaps and panels. The flaps are folded in order 93, 94, 95, 96, 97, and bottom panel 98. The particular sequence of folding is preferred but is not critical, but note that the bottom panel 98 is on the outside and shaped in the desired shape of the bottom. From the outside inward each tab supports the edges of the tabs on top of it. Preferably only the panel 98 is glued to the remaining panels.

The outside bottom panel 98 is a regular hexagon panel whose edges are each of length "s". The diameter of a circle inscribed in the hexagon is "g".

The panels 96, 97 are equilateral triangular panels whose edges are of length "s".

Panel 95 is an irregular pentagon panel with one edge of length "g" and the remaining edges, including the hinge edge 85, of length "s". The long edge is an adjacent edge to the hinge edge 85.

Panel 93 is substantially rectangular with edges of length "s" and "g". The hinge edge 81 is of length "s".

Panel 94 is an irregular pentagon which is shaped substantially the same as panel 93 but with one corner cut off.

Figure 18:
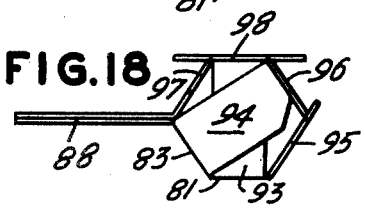
Figure 19:
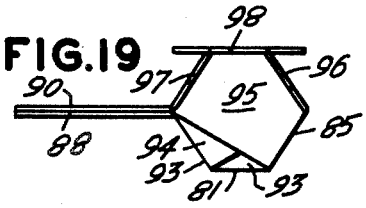
Figure 20:
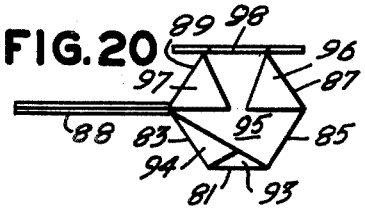
Figure 21:
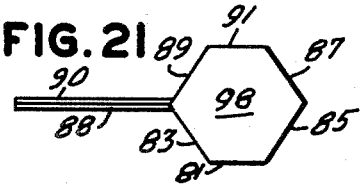

Note that panel 93 may have a width slightly less than s. Then panel 94 will be slightly longer than s, and the corner is cut off to avoid interference when the panel 94 is folded inward as shown in FIG. 18. The outer edge of panel 95 may also be slightly longer than s, but because there are two thicknesses of overlapping front and back panels 88, 90, the slight extra length is accommodated.

Figure 22:
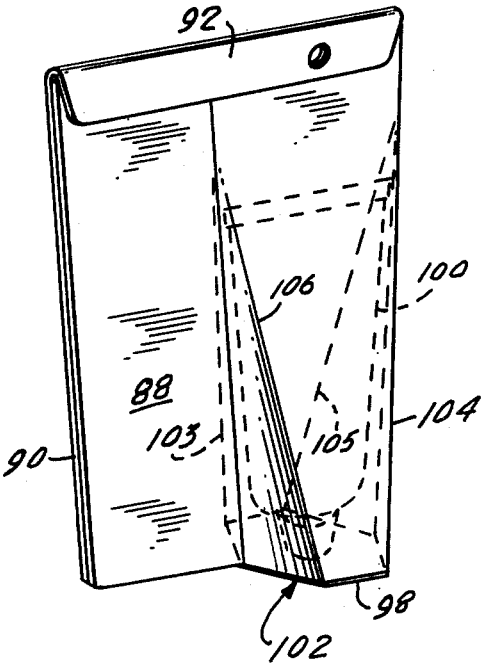
FIG. 22 shows the carton of FIG. 15 fully assembled and upright with the top closed.

The carton is shown assembled in FIG. 22 and containing a tube 100, for example, of cement, The fold-over flap 92 is closed and sealed, and the tube 100 is supported by the bottom 102. The contour lines or scores 103 and 106 give a rounded shape ot the carton and allow it to taper from a hexagon bottom to a two-sided bag configuration at the top. The surfaces 88 and 90 may be used for advertising.

A carton of this invention, therefore, is an advance in the display carton art in that it encloses and supports items to be sold, and the outline of the carton suggests the shape of the contents enclosed.

Although the invention has been described in detail above, it is not intended that the invention should be limited by the description but only by the combined description of the specification and claims.

I claim:

1. A display carton blank, comprising:

front and back panels separated at one side by a hinge line;

a hexagonal outer bottom panel in the shape of the bottom of said carton and hinged from the bottom of one of said panels chosen from the class consisting of said front and back panels;

a plurality of overlappable bottom panels hinged from the bottoms of said front and back panels to overlie said bottom panel, said hexagonal outer panel being irregular and hinged by a first edge to the center of the bottom edge of a first one of said front and back panels, the edges of said outer panel being numbered in sequence with said first and fourth edges being equal in length and parallel, the longer edges separated by a distance h, the second, third, fifth and sixth edges being equal, the internal angles B between the second and third edges and between the fifth and sixth edges being equal and acute, the remaining internal angles A being equal and obtuse;

first and second said identical overlappable panels each being shaped as a quadrilateral with its edges consecutively numbered starting with the hinged edge which is hinged to the sides of the bottom edge of the second one of said front and back panels, the first and second edges being equal in length to said second and third edges of said hexagon panel, the internal angles between said first and second edges being equal to B, and the internal angles between said second and third edges being equal to A;

a third said overlappable panel in the shape of an irregular hexagon, the edges of which are consecutively numbered, with the first edge hinged to the center of the bottom edge of the second one of said front and back panels, the first and fourth edges being parallel and equal in length to the longer side of said outer hexagonal panel, the internal angle between the third and fourth edges and between the fourth and fifth edges being equal to A, the second and fifth edges being colinear with but separated from said fourth edges of said first and second overlappable panels; and, fourth and fifth identical said overlappable panels each triangular shaped and having consecutively numbered edges, with the first said edges hinged to the sides of the bottom edge of said first one of said front and back panels, said first edges being equal to the shorter edges of said outer hexagonal panel, said third edges being colinear but separated from the second and fifth edges of said outer hexagonal panel, the lengths of said second and third edges being such that the areas of said fourth and fifth panels are substantially equal to the portions of the areas of said first and second overlappable panels which are exposed to be attachable to said outer hexagon panel when said blank is erected.

2. The blank of claim 1 and further comprising:

said front and back panels have margin panels substantially their full length on both side edges.

3. A carton erected from the blank of claim 2 wherein;

said front and back panels are confronting but separated at least at the bottom thereof with said confronting margin panels attached to each other;

and said overlappable panels are overlapping each other with said outside panel on the outside of, overlapping and attached to each of said overlappable panels.

4. The carton of claim 3 wherein said first and second overlappable panels are folded on the inside of said carton, said third overlappable panel is folded to overlap a portion of said first and second panels, said fourth and fifth panels are folded to overlap a portion of said first, second and third panels, and said outside panel overlaps and is attached to all of said overlappable panels.

* * * * *